US012078025B2

(12) United States Patent
Massey et al.

(10) Patent No.: US 12,078,025 B2
(45) Date of Patent: Sep. 3, 2024

(54) SUB-SURFACE PLUG RELEASE ASSEMBLY

(71) Applicant: WEATHERFORD TECHNOLOGY HOLDINGS, LLC, Houston, TX (US)

(72) Inventors: Travis Massey, Houston, TX (US); Joshua V. Symms, Cypress, TX (US); Mike Bock, Montgomery, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 164 days.

(21) Appl. No.: 17/844,467

(22) Filed: Jun. 20, 2022

(65) Prior Publication Data

US 2023/0407725 A1 Dec. 21, 2023

(51) Int. Cl.
*E21B 33/16* (2006.01)

(52) U.S. Cl.
CPC ..... *E21B 33/16* (2013.01)

(58) Field of Classification Search
CPC ..... E21B 33/16; E21B 33/165; E21B 33/167; E21B 33/146
See application file for complete search history.

(56) References Cited

U.S. PATENT DOCUMENTS 2,249,511 A * 7/1941 Westall ..... E21B 33/146 166/291
3,364,996 A 1/1968 Brown
4,042,014 A 8/1977 Scott
4,986,361 A * 1/1991 Mueller ..... E21B 23/08 166/381
5,020,597 A 6/1991 Braddick et al.
5,762,139 A * 6/1998 Sullaway ..... E21B 33/16 166/291
6,056,053 A * 5/2000 Giroux ..... E21B 21/10 166/155

(Continued)

FOREIGN PATENT DOCUMENTS

DE 1183039 B 12/1964
JP 2017190441 A 10/2017
WO 2022098448 A1 5/2022

OTHER PUBLICATIONS

Int'l Search Report and Written Opinion in PCT Appl. PCT/US2023/018368 mailed Jul. 4, 2023, 11-pgs.

(Continued)

*Primary Examiner* — David Carroll
(74) *Attorney, Agent, or Firm* — Cabello Hall Zinda, PLLC

(57) ABSTRACT

A multistage cementing assembly is used for cementing casing in a borehole. A subsurface tool on the casing holds a subsurface plug therein using a temporary retainer. The subsurface plug is located in a subsurface location below one or more stage tools or cementing collars on the casing. First stage cement passing down the casing can pass through a passage of the subsurface plug to flow out of a float valve. A wiper plug passed through the casing behind the cement is then engaged with the subsurface plug. Pressure buildup can release the two plugs as a unit from the temporary retainer. Before reaching the float valve, a deformable ring on the subsurface plug can engage in a locator ring on the casing to indicate the plug unit's location during operations. Eventually, additional stages can be cemented using the one or more stage tools uphole on the casing.

20 Claims, 4 Drawing Sheets

(56) References Cited

U.S. PATENT DOCUMENTS

| | | | | |
|---|---|---|---|---|
| 6,082,451 | A * | 7/2000 | Giroux | E21B 21/10 166/153 |
| 8,720,559 | B2 | 5/2014 | Johnson et al. | |
| 8,967,255 | B2 | 3/2015 | Szarka et al. | |
| 9,745,820 | B2 | 8/2017 | Watson et al. | |
| 9,909,382 | B2 | 3/2018 | Schmidt et al. | |
| 9,970,258 | B2 | 5/2018 | Barannikow et al. | |
| 9,976,384 | B2 | 5/2018 | Resweber | |
| 10,132,139 | B1 | 11/2018 | Roberts et al. | |
| 10,378,304 | B2 | 8/2019 | Budde | |
| 10,767,440 | B2 | 9/2020 | Stair et al. | |
| 10,961,803 | B2 | 3/2021 | Budde | |
| 11,078,752 | B2 | 8/2021 | Oliveira et al. | |
| 11,306,562 | B1 | 4/2022 | Giroux et al. | |
| 2007/0261850 | A1* | 11/2007 | Giroux | E21B 33/14 166/291 |
| 2015/0330181 | A1* | 11/2015 | Budde | E21B 34/14 166/185 |
| 2016/0138367 | A1* | 5/2016 | Lirette | E21B 33/146 166/317 |
| 2017/0342800 | A1* | 11/2017 | Themig | E21B 34/063 |
| 2019/0178052 | A1* | 6/2019 | Giroux | E21B 34/14 |

OTHER PUBLICATIONS

Weatherford. "Casing Wiper Plugs and Darts." Copyright 2013. 58 pages.

Weatherford. "Surge-Reduction Technology and SSR Plug Locator System Help to Run and Cement Four Primary Strings with Zero Losses." Real Results. Copyright 2015. 2 pages.

Weatherford. "Float & Stage Equipment." Copyright 2005. 44 pages.

Weatherford. "Plug Locator System." Copyright 2016. 1 page.

Weatherford. "Subsurface-Release Plug Locator System." Copyright 2017. 1 page.

* cited by examiner

SUB-SURFACE PLUG RELEASE ASSEMBLY

BACKGROUND OF THE DISCLOSURE

Cementing operations are used in wellbores to fill the annular space between casing and the formation with cement. When this is done, the cement sets the casing in the wellbore and helps isolate production zones at different depths within the wellbore from one another. During the operation, the cement can be pumped into the annulus from the bottom of the casing (e.g., cementing the long way) or from the top of the casing (e.g., reverse cementing).

Due to weak earth formations or long strings of casing, cementing from the top or bottom of the casing may be undesirable or ineffective. For example, when circulating cement into the annulus from the bottom of the casing, problems may be encountered because a weak earth formation will not support the cement as the cement on the outside of the casing rises in the annulus. As a result, the cement may flow into the formation rather than up the casing annulus. When cementing from the top of the casing, it is often difficult to ensure the entire annulus is cemented.

For these reasons, staged cementing operations can be performed in which different sections or stages of the wellbore's annulus are filled with cement. To do the staged operations, various stage tools can be disposed on the casing string for circulating cement slurry pumped down the casing string into the wellbore annulus at particular locations.

When performing a multi-stage cementing operation, restrictions in the casing's internal diameter do not allow traditional, large-body cementing wiper plugs to be used in the cementing operation. Instead, flex-style plugs having a small core and large fins must be used to pass through the downhole restrictions. While the flex-style plugs have been used for many years and are effective, they have an increased chance of not landing properly at the conclusion of cement displacement. Therefore, installations using the flex-style plugs require a bump indication to be used or require running hydraulically activated tools off the first stage.

In addition, flex-style plugs are known to "dive" when passing through the casing. In other words, the rigidity of the nose relative to the fins for the flex-style plug may not be balanced so the nose may tend to drag along the casing's inner diameter. This decreases the wiping/fluid separation performance of the fins, which leaves room for by-pass/wiping inefficiencies and can ultimately lead to a wet shoe condition. Finally, current flex-style plugs used with stage tools and other restrictions may have an aluminum core and other metal components, which increases the metallic material that needs to be drilled out once the cementing operation is complete.

The subject matter of the present disclosure is directed to overcoming, or at least reducing the effects of, one or more of the problems set forth above.

SUMMARY OF THE DISCLOSURE

As disclosed herein, a method is directed to cementing casing in a borehole. In the method, a subsurface plug is temporarily supported at a support located in the casing. The support is located downhole of a stage cementing collar on the casing. Cement slurry is pumped down the casing, through the stage cementing collar in a closed stage, through the subsurface plug, past a float valve on the casing, and into an annulus between the casing and the borehole. The cement slurry is displaced in the casing by deploying a wiper plug behind the cement slurry. The wiper plug engages in the subsurface plug as a plug unit. In response to pressure in the casing behind the plug unit, the wiper plug and the engaged subsurface plug are released from the support and further displace the cement slurry toward the float valve.

An apparatus disclosed herein is directed to cementing casing in a borehole. The apparatus comprises a subsurface tool, a subsurface plug, a wiper plug, and a support. The subsurface tool is configured to connect on the casing, and the subsurface tool has a bore. The subsurface plug is disposed in the bore of the subsurface tool, and the subsurface plug has a passage therethrough. The wiper plug is configured to pass through the casing and is configured to engage with the subsurface plug as a plug unit. The support is configured to hold the subsurface plug at least temporarily in the bore of the tool. In response to pressure in the casing behind the plug unit, the support is configured to release the subsurface plug.

A system disclosed herein is used on casing in a borehole and is operated by a wiper plug. The system comprises a float valve, a cementing collar, a subsurface tool, a subsurface plug, a support, and a locator tool. The float valve is connected to the casing, and the cementing collar is connected to the casing uphole of the float valve and is configured to pass the wiper plug therethrough. The subsurface tool is connected to the casing between the cementing collar and the float valve, and the subsurface tool has a bore.

The subsurface plug is disposed in the bore of the subsurface tool. The subsurface plug has a passage therethrough, and the passage is configured to engage the wiper plug deployed down the casing. The support is disposed in the bore of the subsurface tool and is configured to hold the subsurface plug at least temporarily in the bore of the tool. The support is configured to release the subsurface plug with the engaged wiper plug as a plug unit in response to pressure in the casing behind the plug unit. The locator tool is connected to the casing between the subsurface tool and the float valve. The locator tool is configured to locate the plug unit at least temporarily of at a location in the casing.

The foregoing summary is not intended to summarize each potential embodiment or every aspect of the present disclosure.

DETAILED DESCRIPTION OF THE DISCLOSURE

Figure 1:
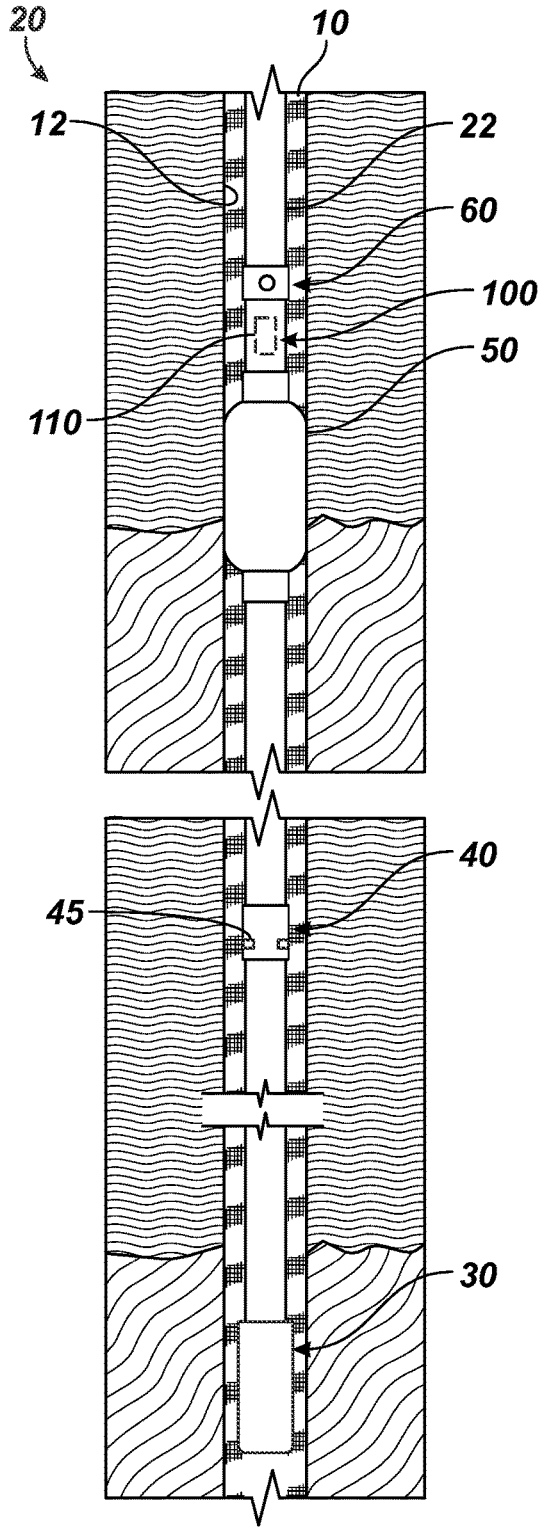
FIG. 1 illustrates a multistage cementing assembly according to the present disclosure.

FIG. 1 illustrates a multistage cementing assembly 20 according to the present disclosure. The assembly 20 has a float valve 30, a plug locator 40, a packer 50, and a stage cementing collar or tool 60 disposed on a casing string 22, liner, or the like disposed in a wellbore 10. Additional stages having packers 50 and stage tools 60 can be used further up the wellbore 10. The assembly 20 allows the casing string 22 to be cemented in the wellbore 10 using two or more stages. In this way, the staged cementation operations can be used for zones in the wellbore 10 experiencing lost circulation, water pressure, low formation pressure, or high-pressure gas.

In general, the float valve 30 can be a float shoe disposed on the toe of the casing 22 and having one or more check valves that permit fluid flow out of the casing 22 but not into the casing 22. Alternatively, the float valve 30 can be a float collar disposed on casing uphole of the casing's toe and having one or more check valves that permit fluid flow out of the casing 22 but not into the casing 22. As a float collar, the float valve 30 can be used together with a float shoe, or just a casing shoe, at the toe of the casing 22 depending on the implementation.

The plug locator 40 includes a housing that couples to joints of the casing 22 at some predetermined number of joints from the float valve 30 so there is a known volume contained in the bore between the locator 40 and float valve 30. Inside, the plug locator 40 has a fixed landing or ring 45, which typically has an angled or wedged edge. During cement operations, the volume of pumped slurry is determined using the rig pumps, but this is not always accurate. The plug locator 40 allows operators to recalculate the required displacement volume needed to complete the cementing operation.

As shown, the annulus casing packer 50 can be run in conjunction with the stage tool 60 to assist in cementing the casing string 22 in the two or more stages. The stage tool 60 is a stage cementing collar or a similar device. The stage tool 60 is typically run above the packer 50, allowing the lower zones of the wellbore 10 to remain uncemented and prevent cement from flowing downhole from the stage. During staged cementing, stages having a weak zone in the formation can be cemented in a way that the hydrostatic pressure of the slurry of cement does not damage the formation.

The cementing operation begins with pumping a first stage of cement down the casing 22 and out the float valve 30 to fill the annulus 12 around the casing 22. Conventionally, a flex-style plug (not shown) would be pumped down the casing 22 and through the various tools of the assembly 20 to land in the float valve 30. Rather than using a flex-style plug, the present assembly 20 includes a sub-surface release system 100 for a large core subsurface plug (110) to be launched during the cementing operations. The sub-surface release system 100 is deployed on the casing 22 with the other tools and releases the large core subsurface plug (110) to close off the float valve during the multistage cementing operations outlined above.

The subsurface plug (110) includes another landing ring (not shown) disposed about the subsurface plug (110). This ring typically fits about the plug's core between fins and has segmented collets or the like. When the collets of the plug's ring engage the wedged ring (45) in the plug locator 40, the subsurface plug (110) is held temporarily until pressure can be built up to compress the collets and force the subsurface plug (110) through the housing's fixed ring (45). Details of the sub-surface release system 100 are described below with respect to FIG. 2, and details of the subsurface plug (110) and the locator 40 are described below with respect to FIG. 3.

To then cement the next stage, pressure can be applied against the landed subsurface plug (110) so the casing packer 50 can be opened, inflated, and closed to isolate the lower portions of the annulus 12 below the packer 50 from being subject to further pressure increases. Instead of using a packer 50, the cement in the lower stage may be allowed to set before cementing the next stage.

After the packer 50 is set to seal off the annulus 12, an opening dart (not shown) is deployed to the stage tool 60 so pressure can be applied against the seated plug to open the stage tool 60. An amount of cement is then pumped behind the opening plug, and the cement is pumped out of the opened stage tool 60 into an adjacent zone of the annulus 12 at the next stage. Once the cement has filled the zone, a closing wiper plug (not shown) is then pumped behind the cement to then close the stage tool 60 for the zone. Multiple stages can be cemented in this manner.

Figure 2:
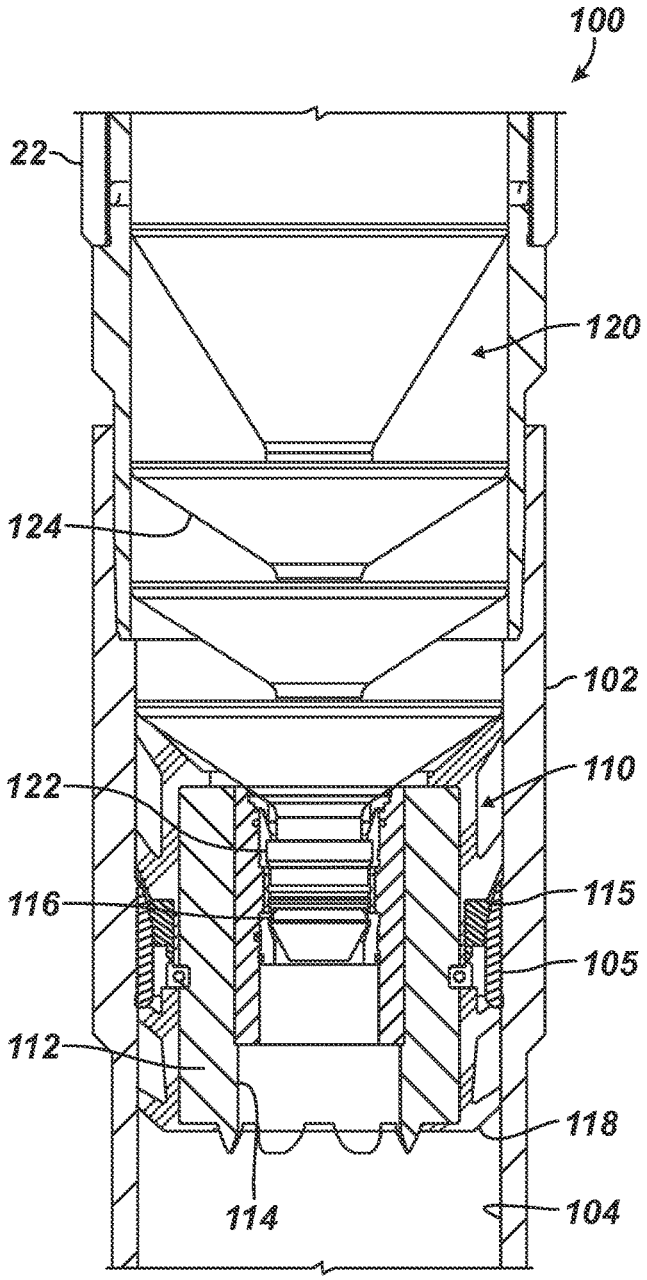
FIG. 2 illustrates a sub-surface release system according to the present disclosure for a multistage cementing assembly.

Turning to FIG. 2, the sub-surface release system 100 includes a tool or housing 102 that couples to tubulars of the casing 22. The tool 102 can be torqued up as an integral part of the casing 22.

The tool 102 includes a tool bore 104 for the passage of cement, plugs, fluid, and the like for operations. A large core, subsurface plug 110 is mounted or supported in the bore 104 and is deployed with the tool 102 on the casing 22 during the installation of the cementing assembly (20: FIG. 1). The subsurface plug 110 includes a core 112 having an internal passage 114 with a seat 116. Preferably, the core 112 is made of a non-metallic material, such as thermoplastic. For good flow through the subsurface plug 110, the passage 114 can be as large as practical. External to the core 112, the subsurface plug 110 includes fins 118 for engaging inside the casing 22 and any other tools or restrictions in the assembly.

The sub-surface release system 100 is deployed on the casing 22 below the stage tool(s) (60) and any typical restrictions that would normally not allow for the passage of the subsurface plug 110. Internally, the passage 112 in the subsurface plug 110 allows for fluid flow so fluid can be pumped through the casing 22 and into the borehole's annulus 12 during run-in of the casing 22 and the like.

Externally, the subsurface plug 110 is mounted or anchored in the bore 104 using a support 105 that holds the subsurface plug 110 at least temporarily in place. For example, the support 105 can use a temporary retainer, such as a shear screw, a shear ring, a shear element, a detent ring, a snap ring, a collet, a dog, a lock, or a catch. The support 105 temporarily mounts or attaches the subsurface plug 110 to the tool 102, and the plug 110 can be released from the support 105 by shearing a shear screw, a shear ring, or a shear element; deforming a detent ring, a snap ring, or a collet; or disengaging a dog, a lock, or a catch.

Externally, the subsurface plug 110 can have an integrated plug location indicator or ring 115 to provide a location indication. The anchor 105 can engage the indicator 115 to hold the subsurface plug 110 in place. After the subsurface plug 110 has been launched from its sub-surface depth, the indicator 115 can indicate the location of the subsurface plug 110 before the subsurface plug 110 contacts its landing point on the float valve 30. The plug location indicator 115 provides a signature of the plug's location.

The subsurface plug 110 has the large core 112, which can support the indicator 115, and the fins 118 on the subsurface plug 110 are designed to handle 500 psi. Integrating such an indicator 115 into a flex-style plug is not typically possible because the core of the flex-style plug is too small and the fins are not designed to handle 500 psi, which would potentially create lodged fins, and far more issues with the cement integrity.

The sub-surface release system 100 is also shown in conjunction with a wiper plug 120, which is not originally deployed with the subsurface plug 110. Instead as noted below, the wiper plug 120 is deployed down the casing 22 to the tool 100 to release the subsurface plug 110 from the bore 104 during the cementing operations. The wiper plug 120 has a head 122 and fins 124. The head 122 is configured to seat, latch, and seal in a seat 116 of the subsurface plug 110 similar to a dart, and the fins 124 are used to wipe the inside of the casing bore 22 and any other restrictions in the assembly.

Figure 3:
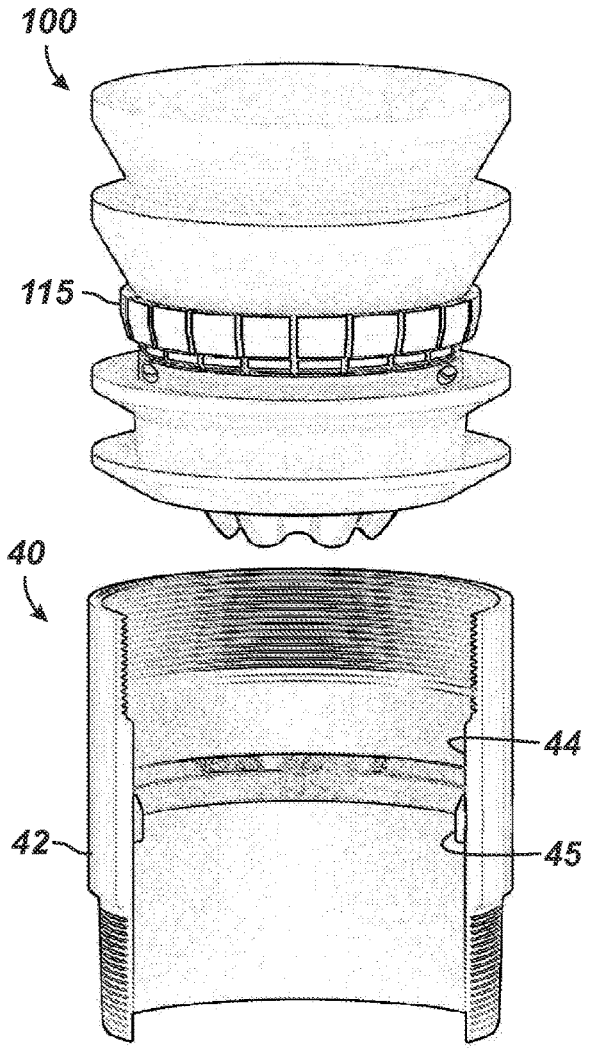
FIG. 3 illustrates an example of a plug locator relative to a large core subsurface plug for the disclosed multistage cementing assembly.

Turning briefly to FIG. 3, an example of a plug locator 40 is illustrated relative to a subsurface plug 110 for the disclosed multistage cementing assembly. The plug locator 40 includes a collar 42 that can be threaded as part of the casing string. A locator landing or ring 45 with an angled landing shoulder is disposed in the bore 44 of the collar 42.

The subsurface plug 110 is shown for comparison and has the plug fins 118 disposed about the core 112. An indicator or locator ring 115 is fixed about the subsurface plug 110 to engage with the locator ring 45 in the plug locator 40. The plug's locator ring 115 can be segmented with collet members, which can be angled outward and flexible inward. This will allow the plug's ring 115 to pass through the angled shoulder of the locator's fixed ring 45. As noted above, the locator ring 115 on the subsurface plug 110 can serve as part of the temporary connection that holds the subsurface plug 100 in the release system 100.

Figure 4:
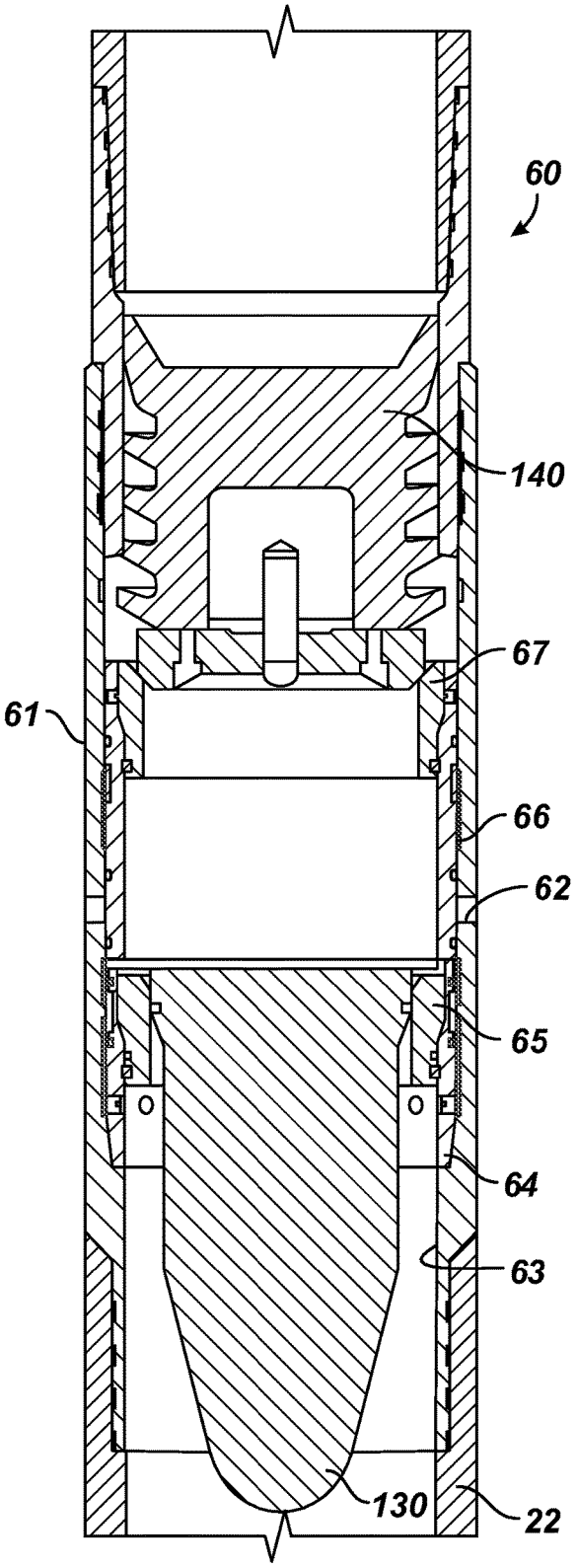
FIG. 4 illustrates an example of a stage cementing collar for the disclosed multistage cementing assembly.

Turning briefly to FIG. 4, an example of a stage tool 60 is illustrated for the disclosed multistage cementing assembly. The stage tool 60 includes a housing 61 that can be threaded onto the casing to be part of the casing string. One or more side ports 62 allow for communication out of a bore 63 of the housing 61 of the tool 60 to the surrounding annulus.

An opening sleeve 64 is disposed in the housing's bore 63 and has a first seat Initially, the opening sleeve 64 closes off communication to the port(s) 62 until an opening plug 130 is landed on the seat 65 to shift the sleeve 64 open relative to the port so that cement can be pumped out into the surrounding annulus. Meanwhile, a closing sleeve 66 is also disposed in the housing's bore 63 and has a second seat 67. Initially, the closing sleeve 66 is open relative to the port(s) 62 until a closing plug 140 is landed on the seat 67 to shift the sleeve 64 closed relative to the port(s) 62 to close off the stage.

The operation of the sub-surface release system 100 in a multistage cementing assembly will now be described. FIGS. 5A-5F illustrate the sub-surface release assembly 100 and portions of a multistage cementing assembly 20 during stages of operation.

Figure 5A:
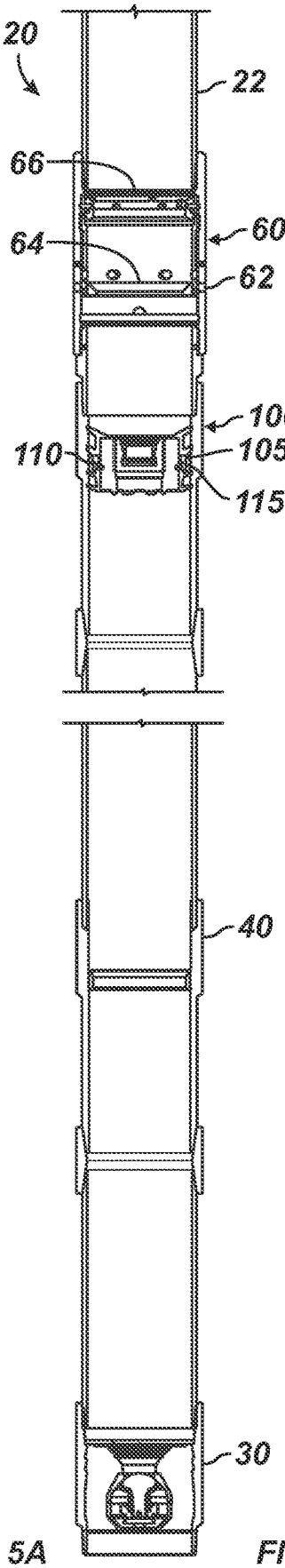
FIGS. 5A-5F illustrate the sub-surface release system and the multistage cementing assembly during stages of operation.
Figure 5B:
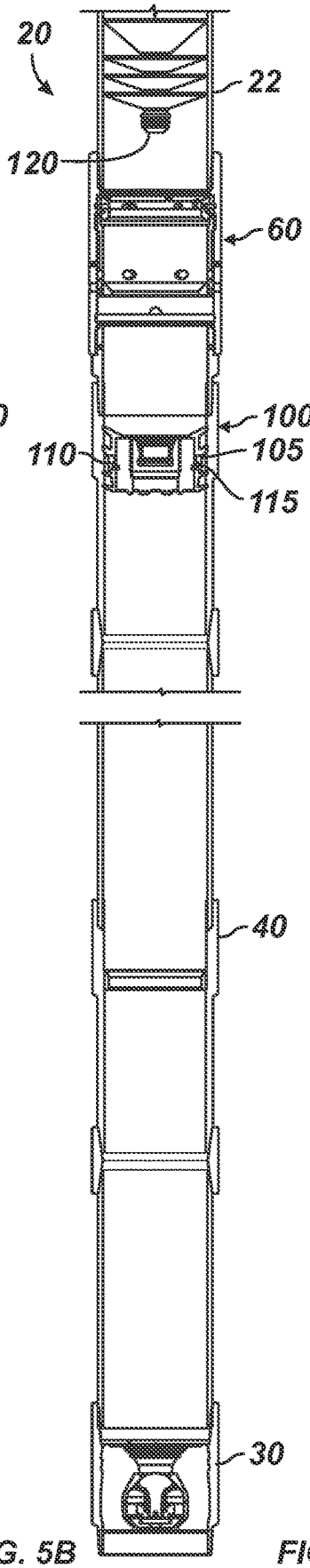

As shown in FIG. 5A, the assembly 20 installed in the wellbore 10 includes the casing 22 having a stage tool 60, a sub-surface release assembly 100, a plug locator and a float valve 30. Only the most downhole stage tool 60 is shown. The assembly 20 can include additional stage tools uphole on the casing 22 and can include additional components, such as packers.

As noted, the stage tool 60 can have side ports 62, a first seat 64, and a second seat 66. The first seat 64 initially closes off the side ports 62. When the first seat 64 is moved by engagement of an opening plug (not shown), flow can pass out the side ports 62 for the staged cementing. Using a closing plug (not shown), the second seat 66 can then be moved to close the side ports 62.

The large core plug 110 is installed in the sub-surface release assembly 100 disposed on the casing 22 below the stage tool 60. The assembly 100 is run in hole so the large core plug 110 is held in place below the most-downhole stage tool 60. Fluid communication for run-in can pass through the central bore (114) of the large core plug 110.

Once the casing 22 has been run to depth and the wellbore 100 is prepared for cementing, the staged cementing operations can begin. In the first stage cementing steps, first stage cement is pumped down the casing 22 while all of the stage tools 60 are closed. The cement can flow through the bore (114) of the large core subsurface plug 110 held in the assembly 100 below the most-downhole stage tool 60. As then shown in FIG. 5B, a launch plug 120 is launched behind the first stage cement to displace the cement and to act as a barrier between the first stage cement and the displacement fluid pumped behind the launch plug 120.

Figure 5C:
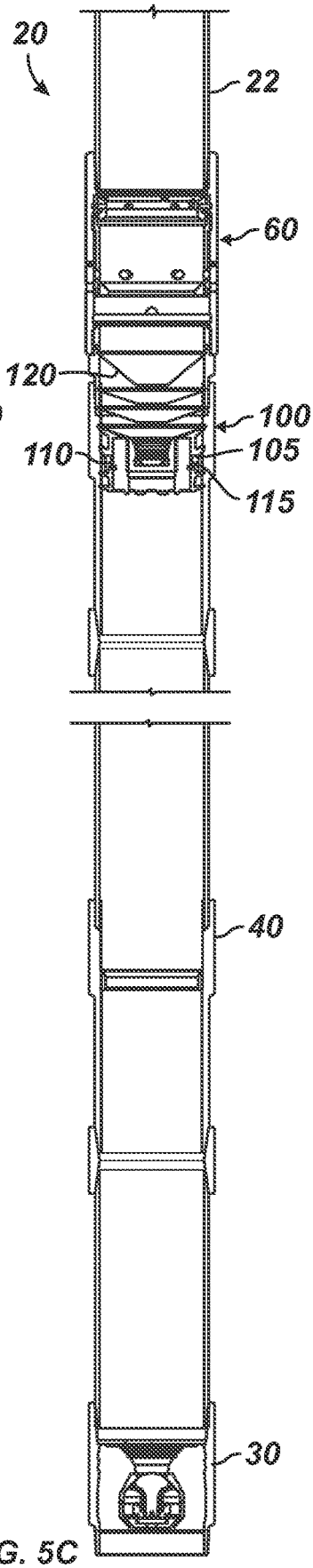
Figure 5D:
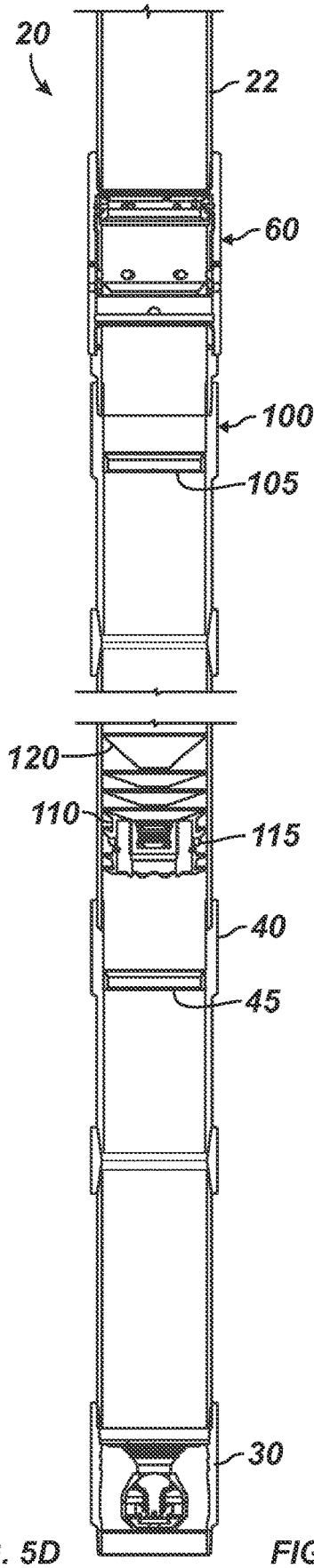

As shown in FIGS. 5C-5D, the launch plug 120 passes through the stage tools and other restrictions of the assembly 20. A latch-up on the nose 122 of the launch plug 120 then engages in the subsurface plug 110 and latches into the seat (116) of the subsurface plug 110. Pressure-build up in the displacement fluid behind the engaged plugs 110, 120 releases the temporary retention of the subsurface plug 110 so the plugs 110, 120 can be launched as a plug unit from the release system 100 and displaced in the casing 22 toward the toe.

The subsurface plug 110 offers superior wiping efficiency inside the casing 22 due to the large body to fin rigidity ratio on the subsurface plug 110. In this way, as it is displaced in the casing 22, the large core plug 110 can prevent fluid contamination or bypass of fluids past the fins 118 so the plug 110 can provide accurate plug displacement volumetrics and accurate plug bump.

Figure 5E:
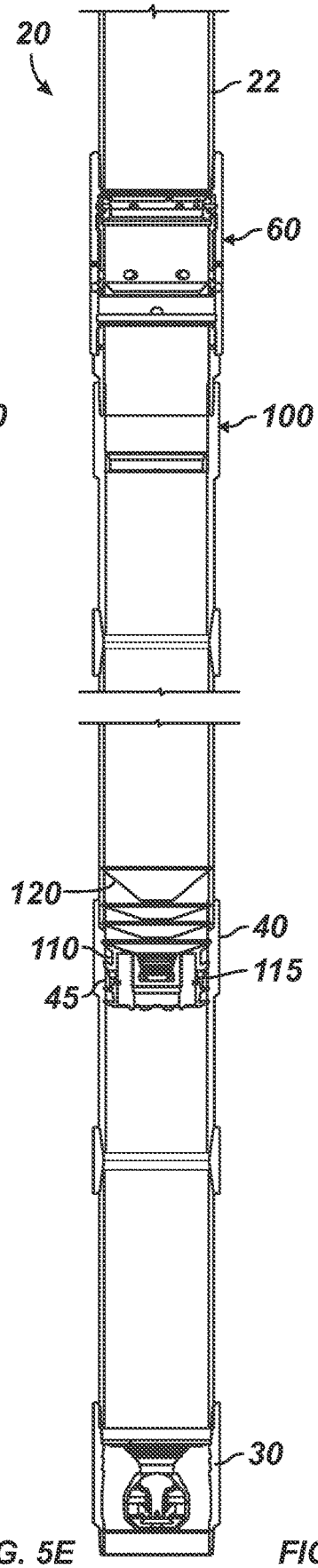
Figure 5F:
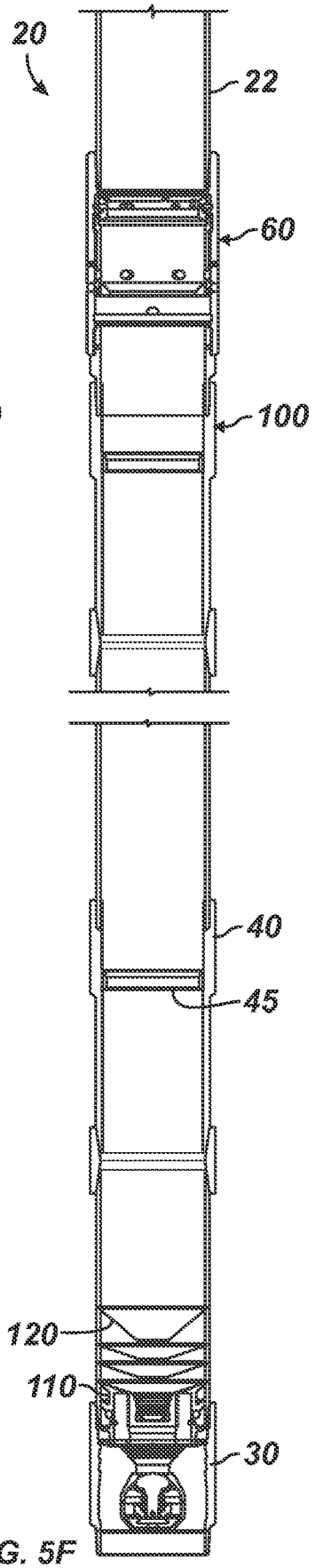

As then shown in FIG. 5E, the large core plug 110 with the engaged launch plug 120 locates on an indicator or shoulder (45) of the plug locator 40 on the casing 22, indicating the plug's location in the assembly 20. The location of the plug 110 also indicates what volume of cement remains in the shoe track of the assembly 20 between the locator 40 and the float valve 30. Pressure-build up in the displacement fluid behind the plugs 110, 120 eventually forces the plugs 110, 120 through the locator 40. Ultimately, the plugs 110, 120 then land as a unit on the float valve 30 of the assembly 20. Additional stages can then be cemented using customary multi-stage cementing steps as noted previously by using the stage tool 60, opening plug (130), and closing plug (140).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of cementing casing in a borehole, the method comprising:

temporarily supporting a subsurface plug at a support located in the casing, the support located downhole of a stage cementing collar on the casing;

pumping cement slurry down the casing, through the stage cementing collar in a closed stage, through the subsurface plug, past a float valve on the casing, and into an annulus between the casing and the borehole;

displacing the cement slurry in the casing by deploying a wiper plug behind the cement slurry;

engaging the wiper plug in the subsurface plug;

releasing the wiper plug engaged in the subsurface plug as a plug unit from the support; and further displacing the cement slurry with the plug unit toward the float valve.

2. The method of claim 1, further comprising temporarily locating the plug unit at a location in the casing uphole of the float valve.

3. The method of claim 2, further comprising:

verifying the temporary locating of the plug unit at the location; and calculating a volume of displacement fluid to displace the plug unit from the location to the float valve.

4. The method of claim 2, wherein temporarily locating the plug unit at the location in the casing uphole of the float valve comprises:

engaging a deformable ring on the subsurface plug against a fixed ring disposed in the casing;

building up pressure behind the plug unit; and releasing the plug unit from the location by deforming the deformable ring past the fixed ring in response to a pressure threshold.

5. The method of claim 1, wherein engaging the wiper plug in the subsurface plug comprises latching a head of the wiper plug in a passage of the subsurface plug.

6. The method of claim 5, wherein engaging the wiper plug in the subsurface plug comprises sealing the head of the wiper plug in the passage of the subsurface plug.

7. The method of claim 1, wherein releasing the plug unit comprises:

building up pressure behind the plug unit; and releasing a temporary retainer between a portion of the casing and the subsurface plug in response to a pressure threshold.

8. The method of claim 7, wherein releasing the temporary retainer comprises shearing a shear screw, a shear ring, or a shear element; deforming a detent ring, a snap ring, or a collet; or disengaging a dog, a lock, or a catch.

9. The method of claim 1, further comprising pumping a stage of cement slurry into the annulus through the stage cementing collar.

10. The method of claim 9, wherein pumping the stage of cement slurry into the annulus through the stage cementing collar comprises:

deploying an opening plug down the casing to the stage cementing collar;

opening the stage cementing collar with application of pressure against the opening plug seated in the stage cementing collar;

pumping the stage of cement slurry out of the open stage cementing collar and into the annulus;

deploying a closing plug behind the stage of cement slurry to the stage cementing collar; and closing the stage cementing collar with application of pressure against the closing plug seated in the stage cementing collar.

11. The method of claim 1, further comprising:

performing a pressure test with the plug unit landed on the float valve; and drilling out the plug unit, the float valve, and residual cement in a shoe track downhole of the float valve.

12. An apparatus for cementing casing in a borehole, the apparatus comprising:

a subsurface tool configured to connect on the casing, the subsurface tool having a bore;

a subsurface plug disposed in the bore of the subsurface tool, the subsurface plug having a passage therethrough;

a wiper plug configured to pass through the casing and configured to engage with the subsurface plug as a plug unit; and a support configured to hold the subsurface plug at least temporarily in the bore of the subsurface tool, the support being configured to release the subsurface plug in response to pressure in the casing behind the plug unit.

13. The apparatus of claim 12, further comprising a stage cementing collar configured to connect on the casing uphole of the subsurface tool, wherein the wiper plug is configured to pass through the stage cementing collar.

14. The apparatus of claim 13, further comprising:

an opening plug deployable down the casing and being configured to open the stage cementing collar in response to first pressure applied in the casing against the opening plug seated in the stage cementing collar; and a closing plug deployable down the casing and being configured to close the stage cementing collar in response to second pressure applied in the casing against the closing plug seated in the stage cementing collar.

15. The apparatus of claim 12, further comprising a plug locator configured to connect on the casing downhole of the subsurface tool, the plug locator being configured to locate the plug unit at least temporarily at a location in the casing.

16. The apparatus of claim 15, wherein the plug locator comprises a fixed ring disposed therein; and wherein the subsurface plug comprises a deformable ring disposed thereabout, the deformable ring being configured to engage with the fixed ring and being configured to deform past the fixed ring in response to pressure applied in the casing behind the plug unit above a threshold.

17. The apparatus of claim 12, further comprising a float valve configured to connect on the casing, the plug unit being configured to land on a portion of the float valve.

18. The apparatus of claim 12, wherein the wiper plug comprises a head configured to engage in the passage of the subsurface plug.

19. The apparatus of claim 12, wherein the support comprises a temporary retainer selected from the group consisting of a shear screw, a shear ring, a shear element, a detent ring, a snap ring, a collet, a dog, a lock, and a catch.

20. A system used on casing in a borehole and being operated by a wiper plug, the system comprising:

a float valve connected to the casing;

a cementing collar connected to the casing uphole of the float valve and being configured to pass the wiper plug therethrough;

a subsurface tool connected to the casing between the cementing collar and the float valve, the subsurface tool having a bore;

a subsurface plug disposed in the bore of the subsurface tool, the subsurface plug having a passage therethrough, the passage configured to engage the wiper plug deployed down the casing;

a support disposed in the bore of the subsurface tool and configured to hold the subsurface plug at least temporarily in the bore of the subsurface tool, the support being configured to release the subsurface plug with the engaged wiper plug as a plug unit in response to pressure in the casing behind the plug unit; and a plug locator connected to the casing between the subsurface tool and the float valve, the plug locator being configured to locate the plug unit at least temporarily at a location in the casing.

* * * * *